US005667954A

United States Patent [19]

Irving et al.

[11] Patent Number: 5,667,954

[45] Date of Patent: Sep. 16, 1997

[54] PHOTOGRAPHIC EMULSIONS OF ENHANCED SENSITIVITY AND REDUCED CONTRAST

[75] Inventors: Mark Edward Irving, Rochester; Donald Lee Black, Webster, both of N.Y.

[73] Assignee: Eastman Kodak Company, Rochester, N.Y.

[21] Appl. No.: 653,855

[22] Filed: May 28, 1996

[51] Int. Cl.[6] ..... G03C 1/035

[52] U.S. Cl. ..... 430/567

[58] Field of Search ..... 430/567, 569

[56] References Cited

U.S. PATENT DOCUMENTS

| | | | |
|---|---|---|---|
| 4,433,048 | 2/1984 | Solberg et al. | 430/567 |
| 5,314,793 | 5/1994 | Chang et al. | 430/567 |
| 5,470,698 | 11/1995 | Wen | 430/567 |
| 5,476,760 | 12/1995 | Fenton et al. | 430/567 |
| 5,567,580 | 10/1996 | Fenton et al. | 430/567 |

*Primary Examiner*—Mark F. Huff
*Attorney, Agent, or Firm*—Carl O. Thomas

[57] ABSTRACT

An emulsion of enhanced photographic sensitivity and reduced contrast is disclosed containing high bromide tabular grains having a non-uniform iodide distribution, including (a) a peripheral zone extending inwardly from edges and corners of the tabular grains and providing (i) a maximum iodide concentration along the edges and (ii) a lower iodide concentration at the corners than elsewhere along the edges, (b) a central zone providing a minimum iodide concentration and accounting for at least 35 percent of total silver forming the tabular grains and, (c) extending from the central zone to the peripheral zone, an intermediate zone (i) containing a higher iodide concentration than the central zone, ranging from greater than 2 to 10 mole percent, based on silver forming the intermediate zone, and (ii) accounting for from 5 to 35 percent of total silver forming the tabular grains.

8 Claims, No Drawings

PHOTOGRAPHIC EMULSIONS OF ENHANCED SENSITIVITY AND REDUCED CONTRAST

FIELD OF THE INVENTION

The invention relates to photographic emulsions.

DEFINITION OF TERMS

In referring to silver halide emulsions, grains or grain regions containing two or more halides, the halides are named in order of ascending concentrations.

The term "high bromide" in referring to silver halide grains and emulsions is employed to indicate greater than 50 mole percent bromide, based on total silver, forming the grains and emulsions, respectively.

The term "tabular grain" is defined as a grain having an aspect ratio of at least 2.

The term "tabular grain emulsion" is defined as an emulsion in which greater than 50 percent of total grain projected area is accounted for by tabular grains.

The terms "total silver" and "total iodide" are used to indicate all of the silver and iodide, respectively, forming an entire grain or an entire grain population. Other references to "silver" or "iodide" refer to the silver or iodide forming the relevant portion of the grain structure—i.e., the zone or specific location under discussion.

The symbol "μm" is used to represent micrometer(s).

The symbol "M %" is used to designate mole percent.

The term "oxidized gelatin" refers to gelatin that has been treated with an oxidizing agent so that less than 30 micromoles of methionine per gram of gelatin remains unoxidized.

*Research Disclosure* is published by Kenneth Mason Publications, Ltd., Dudley House, 12 North St., Emsworth, Hampshire P010 7DQ, England.

BACKGROUND

Fenton et al U.S. Pat. No. 5,476,760 discloses tabular grain emulsions with a non-uniform iodide distribution within the tabular grains that enhances photographic sensitivity. The tabular grains are formed by starting with a conventional tabular grain emulsion in which the tabular grains have a surface iodide concentration of less than 2 mole percent and, preferably, an iodide concentration of less than 2 mole percent throughout. Iodide ions are then introduced into the emulsion without concurrent silver ion introduction to displace chloride and/or bromide ions preferentially from the peripheral edges and particularly the corners of the tabular grains. This is followed by silver ion introduction, which results in the further deposition of silver halide and, surprisingly, a rearrangement of iodide ion that results in a maximum iodide concentration along the peripheral edges of the tabular grains and a lower iodide concentration within the corners of the tabular grains than elsewhere along their edges. Fenton et al demonstrates unexpectedly high levels of photographic sensitivity for these emulsions.

When a maximum peripheral iodide concentration is created by a conventional double-jet precipitation technique, the iodide concentration at the corners and elsewhere along the edges of the tabular grains is similar and the sensitivity of the resulting emulsion is significantly less than that of a comparable emulsion having the structure disclosed by Fenton et al.

PROBLEM TO BE SOLVED

In constructing emulsions according to the teachings of Fenton et al starting with preferred tabular grain structures—that is, those containing less than 2 mole percent iodide throughout, it has been observed that the emulsions, though exhibiting high levels of sensitivity, also exhibit higher than desired levels of contrast.

Although iodide is known to contribute to increased photographic sensitivity and is therefore commonly taught be included in tabular grain emulsions intended for camera speed applications, it is well recognized that iodide ion incorporation also presents disadvantages. For example, it is well known that iodide ion slows the rate of photographic development and, still more objectionably, slows the rate of fixing. Additionally, iodide ion build up in processing solutions requires their replacement more frequently than the build up of other halide ions. Finally, the ecological burden of iodide ion in spent processing solutions is greater than that presented by bromide and/or chloride ions.

SUMMARY OF THE INVENTION

The present invention is directed to high bromide tabular grain emulsions that are an improvement on the emulsions of Fenton et al. Specifically, the emulsions of the invention realize the sensitivity enhancements of Fenton et al and a more favorable relationship between contrast and iodide content. Still more specifically, the present invention has identified an optimum iodide placement within the tabular grains for reducing contrast. This allows lower contrasts to be realized than attainable using the preferred (less than 2 mole percent iodide) starting tabular grains taught by Fenton et al. Alternatively, when higher iodide levels are employed in the tabular grains of Fenton et al, the present invention allows acceptable levels of contrast to be realized with lower overall levels of iodide.

In one aspect, this invention is directed to an emulsion of enhanced photographic sensitivity and reduced contrast comprised of a dispersing medium and tabular grains containing greater than 50 mole percent bromide, based on silver, and having a non-uniform iodide distribution, including (a) a peripheral zone extending inwardly from edges and corners of the tabular grains and providing (i) a maximum iodide concentration along the edges and (ii) a lower iodide concentration at the corners than elsewhere along the edges, (b) a central zone providing a minimum iodide concentration and accounting for at least 35 percent of total silver forming the tabular grains, and, (c) extending from the central zone to the peripheral zone, an intermediate zone (i) containing a higher iodide concentration than the central zone, ranging from greater than 2 to 10 mole percent, based on silver forming the intermediate zone, and (ii) accounting for from 5 to 35 percent of total silver forming the tabular grains.

DESCRIPTION OF PREFERRED EMBODIMENTS

The emulsions of the invention contain tabular grains having a peripheral zone of the type disclosed by Fenton et al, cited above and here incorporated by reference. That is, the peripheral zone provides a maximum iodide concentration along the edges of the tabular grain and a lower iodide concentration at the corners of the tabular grains than elsewhere along their edges. The peripheral zone can be formed as taught by Fenton et al.

The advantages of the emulsions of the present invention over those of Fenton et al result from two distinct features:

First, iodide incorporation within the host portion of the tabular grains (i.e., within the tabular grains that are peripherally modified to form the peripheral zone) is relied upon to reduce contrast.

Second, iodide placement within the host tabular grain structure is selected to provide an increased reduction in contrast with a decreased inclusion of iodide. Stated quantitatively, iodide placement within the host portion of the tabular grains is chosen to provide an increase in the relationship:

$$\Delta\gamma \div \Delta I \quad (I)$$

where $\Delta\gamma$ is the reduction in contrast of the emulsion of the invention and $\Delta I$ is the increase in iodide concentration as compared to an otherwise comparable emulsion differing in iodide concentration. As demonstrated in the Examples below, it is the increased amount of iodide in the host portions of the tabular grains that is responsible for reducing contrast; however, in comparing emulsions with the similar amounts of iodide in the peripheral zones of the tabular grains, measurements can be simplified by basing comparisons on overall iodide concentrations.

The tabular grains responsible for increased sensitivity and decreased contrast in the emulsions of the invention, viewed in cross-section, exhibit the following structure:

Tabular Grain of the Invention

| PZ | IZ | CZ | IZ | PZ |
|---|---|---|---|---|

where

PZ represents an annular peripheral zone;

CZ represents a central zone; and

IZ represents an annular intermediate zone.

The central zone CZ contains the lowest iodide concentrations found in the tabular grain structure. The central zone is formed by preparing a conventional tabular grain emulsion that contains less than 2 mole percent iodide, based on total silver. Preferably the central zone is formed by preparing an iodide-free tabular grain emulsion—e.g. a silver bromide or silver chlorobromide tabular grain emulsion. When the intermediate and peripheral zones IZ and PZ are formed, some iodide may be distributed over the surface of the central zone raising its iodide concentration within a surface region extending a few Angstroms below its surface. Below the surface region the central zone contains the lowest iodide concentrations found at any point in the tabular grains. The average iodide concentration of the central zone is less than that of intermediate and peripheral zones.

The central zone accounts for a minimum of 35 percent of the total silver forming the tabular grains. The maximum percent of total silver provided by the central zone is, of course, limited only by the minimum amounts of silver required to form the intermediate and peripheral zones.

The intermediate zone IZ is formed by continuing the tabular grain precipitation that provides the tabular grains forming the central zone, but with iodide ions (or an increased level of iodide ions) being run into the emulsion dispersing medium along with silver and halide ions. In a typical precipitation, a double-jet precipitation is contemplated in which iodide (or increased iodide) ion is run into the dispersing medium through the same jet as the remaining halide (bromide or a mixture of bromide and chloride) ions while silver ion is being concurrently introduced through a separate jet. Alternatively, the iodide ion or each halide ion can be introduced through a separate jet. Iodide ion introduction at the increased concentration levels required by the intermediate zone is continued through the termination of precipitation of the intermediate zone.

The concentration of iodide in the intermediate zone ranges from greater than 2 to 10 (preferably 2.5 to 8) mole percent, based on silver forming the intermediate zone. The intermediate zone accounts for from 5 to 35 percent of the total silver forming the tabular grains.

The function of the iodide incorporated in the intermediate zone is to reduce contrast. Iodide concentrations in the central zone are minimized, since it has been demonstrated in the Example below that the more centrally the iodide is located in the grain structure the less effective it is in reducing contrast. As the Examples demonstrate, interposing a lower iodide annular zone between the intermediate zone and the peripheral zone (1) requires higher iodide concentrations to achieve comparable reductions in contrast or (2) results in higher levels of contrast when similar levels of iodide are employed. Quantitatively, $\Delta\gamma \div \Delta I$ is a higher value when the intermediate zone extends to the peripheral zone. Iodide has progressively less influence on emulsion contrast, the earlier its introduction occurs during tabular grain growth.

From the discussion above, preparation of the tabular grains of the invention occurs in three distinct stages:

First, a starting, conventional tabular grain emulsion provides the central zone of the tabular grains of the invention:

Starting Tabular Grain

| CZ |
|---|

Second, precipitation onto the starting tabular grains is undertaken to form the intermediate zone. The central zone and the intermediate zone together form a host tabular grain structure for formation of the peripheral zone.

Host Tabular Grain

| IZ | CZ | IZ |
|---|---|---|

Third, precipitation onto the host tabular grains to form the peripheral region is undertaken as taught by Fenton et al, cited above, the sole difference being that the composition of the host tabular grains has been modified to realize the advantages of the invention.

Tabular Grain of the Invention

| PZ | IZ | CZ | IZ | PZ |
|---|---|---|---|---|

Subject to the restriction of having an overall all iodide concentration of less than 2 mole percent, based on total silver, the starting tabular grain emulsions can be selected from among the following, illustrative conventional tabular grain emulsions:

| | |
|---|---|
| Kofron et al | U.S. Pat. No. 4,439,520 |
| Wilgus et al | U.S. Pat. No. 4,434,226 |
| Daubendiek et al | U.S. Pat. No. 4,414,310 |
| Daubendiek et al | U.S. Pat. No. 4,672,027 |
| Daubendiek et al | U.S. Pat. No. 4,693,964 |
| Maskasky | U.S. Pat. No. 4,713,320 |
| Daubendiek et al | U.S. Pat. No. 4,914,014 |
| Antoniades et al | U.S. Pat. No. 5,250,403 |

-continued

| | |
|---|---|
| Tsaur et al | U.S. Pat. No. 5,147,771 |
| Tsaur et al | U.S. Pat. No. 5,147,772 |
| Tsaur et al | U.S. Pat. No. 5,147,773 |
| Tsaur et al | U.S. Pat. No. 5,171,659 |
| Tsaur et al | U.S. Pat. No. 5,210,013 |
| Kim et al | U.S. Pat. No. 5,236,817 |
| Kim et al | U.S. Pat. No. 5,272,048 |
| Tsaur et al | U.S. Pat. No. 5,252,453 |
| Brust | U.S. Pat. No. 5,248,587 |
| Chang | U.S. Pat. No. 5,254,453 |
| Delton | U.S. Pat. No. 5,372,927 |
| Delton | U.S. Pat. No. 5,460,934 |
| Maskasky | U.S. Pat. No. 5,411,851 |
| Maskasky | U.S. Pat. No. 5,411,853 |
| Maskasky | U.S. Pat. No. 5,418,125 |

Continuing precipitation, but with increased iodide concentrations to transform the starting tabular grains into the host tabular grains can be realized merely by adding iodide as the run progresses. Solberg et al U.S. Pat. No. 4,433,226 discloses techniques for ramping iodide to progressively higher levels as precipitation progresses. Daubendiek et al U.S. Pat. No. 5,503,971 discloses ultrathin (<0.07 μm) tabular grains in which a peripheral region has been grown to contain a higher iodide concentration than a central region. The techniques of Solberg et al and Daubendiek et al '971 can be readily adapted to the precipitations of the patents cited above to show preparation of starting tabular grains to produce the host tabular grain emulsions. The teachings Solberg et al, Daubendiek et al '971 and each of the patents listed above are here incorporated by reference.

Once a host tabular grain emulsion has been provided, formation of the peripheral zone to enhance sensitivity can commence under any convenient conventional emulsion precipitation condition. For example, iodide introduction to form the peripheral zone can commence immediately upon completing precipitation of the host tabular grain emulsion. When the host tabular grain emulsion has been previously prepared and is later introduced into the reaction vessel, conditions within the reaction vessel are adjusted within conventional tabular grain emulsion preparation parameters to those present at the conclusion of host tabular grain emulsion precipitation, taught by the starting and host tabular grain emulsion citations above.

Iodide is introduced as a solute into the reaction vessel containing the host tabular grain emulsion. Any water soluble iodide salt can be employed for supplying the iodide solute. For example, the iodide can be introduced in the form of an aqueous solution of an ammonium, alkali or alkaline earth iodide.

Instead of providing the iodide solute in the form of an iodide salt, it can instead be provided in the form of an organic iodide compound, as taught by Kikuchi et al EPO 0 561 415. In this instance a compound satisfying the formula:

$$R—I \qquad \text{(II)}$$

is employed, wherein I represents iodide and R represents a monovalent organic residue which releases iodide ion upon reacting with a base or a nucleophilic reagent acting as an iodide releasing agent. When this approach is employed iodide compound (II) is introduced followed by introduction of the iodide releasing agent.

As a further improvement R—I can be selected from among the methionine alkylating agents taught by King et al U.S. Pat. No. 4,942,120, the disclosure of which is here incorporated by reference. These compounds include α-iodocarboxylic acids (e.g., iodoacetic acid), α-iodoamides (e.g., iodoacetamide), iodoalkanes (e.g., iodomethane) and iodoalkenes (e.g., allyl iodide).

A common alternative method in the art for introducing iodide during silver halide precipitation is to introduce iodide ion in the form of a silver iodide Lippmann emulsion. The introduction of iodide in the form of a silver salt does not satisfy the requirements of the invention.

In the preparation of the tabular grain emulsions of the invention iodide ion is introduced without concurrently introducing silver. This creates conditions within the emulsion that drive iodide ions into the face centered cubic crystal lattice of the tabular grains. The driving force for iodide introduction into the tabular grain crystal lattice structure can be appreciated by considering the following equilibrium relationship:

$$Ag^+ + X^- AgX \qquad \text{(III)}$$

where X represents halide. From relationship (III) it is apparent that most of the silver and halide ions at equilibrium are in an insoluble form while the concentration of soluble silver ions ($Ag^+$) and halide ions ($X^-$) is limited. However, it is important to observe the equilibrium is a dynamic equilibrium—that is, a specific iodide is not fixed in either the right hand or left hand position in relationship (III). Rather, a constant interchange of iodide ion between the left and right hand positions is occurring.

At any given temperature the activity product of $Ag^+$ and $X^-$ is at equilibrium a constant and satisfies the relationship:

$$Ksp=[Ag^+][X^-] \qquad \text{(IV)}$$

where Ksp is the solubility product constant of the silver halide. To avoid working with small fractions the following relationship is also widely employed:

$$-\log Ksp=pAg+pX \qquad \text{(V)}$$

where pAg represents the negative logarithm of the equilibrium silver ion activity and pX represents the negative logarithm of the equilibrium halide ion activity. From relationship (V) it is apparent that the larger the value of the –log Ksp for a given halide, the lower is its solubility. The relative solubilities of the photographic halides (Cl, Br and I) can be appreciated by reference to Table I:

TABLE I

| Temp. °C. | AgCl -log Ksp | AgI -log Ksp | AgBr -log Ksp |
|---|---|---|---|
| 40 | 9.2 | 15.2 | 11.6 |
| 50 | 8.9 | 14.6 | 11.2 |
| 60 | 8.6 | 14.1 | 10.8 |
| 80 | 8.1 | 13.2 | 10.1 |

From Table I it is apparent that at 40° C. the solubility of AgCl is one million times higher than that of silver iodide, while, within the temperature range reported in Table I the solubility of AgBr ranges from about one thousand to ten thousand times that of AgI. Thus, when iodide ion is introduced into the starting tabular grain emulsion without concurrent introduction of silver ion, there are strong equilibrium forces at work driving the iodide ion into the crystal lattice structure in displacement of the more soluble halide ions already present.

The benefits of the invention are not realized if all of the more soluble halide ions in the crystal lattice structure of the host tabular grains are replaced by iodide. This would destroy the face centered cubic crystal lattice structure, since iodide can only be accommodated in a lattice structure to a limited degree, and the net effect would be to destroy the tabular configuration of the grains. Thus, it is specifically contemplated to limit the iodide ion introduced to 10 mole percent or less, preferably 5 mole percent or less, of the total silver forming the host tabular grain emulsion. A minimum iodide introduction of at least 0.5 mole percent, preferably at least 1.0 mole percent, based on host emulsion silver, is contemplated.

When the iodide ion is run into the host tabular grain emulsion at rates comparable to those employed in conventional double-jet run salt additions, the iodide ion that enters the tabular grains by halide displacement is not uniformly or randomly distributed. Clearly the surface of the tabular grains are more accessible for halide displacement. Further, on the surfaces of the tabular grains, halide displacement by iodide occurs in a preferential order. The crystal lattice structure at the corners of the tabular grains is most susceptible to halide ion displacement, followed by the edges of the tabular grains. The major faces of the tabular grains are least susceptible to halide ion displacement. It is believed that, at the conclusion of the iodide ion introduction step (including any necessary introduction of iodide releasing agent), the highest iodide concentrations in the tabular grains occur in that portion of the crystal lattice structure forming the corners of the tabular grains.

The next step of the process of preparation is to remove iodide ion selectively from the corners of the tabular grains. This is accomplished by introducing silver as a solute. That is, the silver is introduced in a soluble form, analogous to that described above for iodide introduction. In a preferred form the silver solute is introduced in the form of an aqueous solution similarly as in conventional single-jet or double-jet precipitations. For example, the silver is preferably introduced as an aqueous silver nitrate solution. No additional iodide ion is introduced during silver introduction.

The amount of silver introduced is in excess of the iodide introduced into the starting tabular grain emulsion during the iodide introduction step. The amount of silver introduced is preferably on a molar basis from 2 to 20 (most preferably 2 to 10) times the iodide introduced in the iodide introduction step.

When silver ion is introduced into the high corner iodide tabular grain emulsion, halide ion is present in the dispersing medium available to react with the silver ion. One source of the halide ion comes from relationship (III). The primary source of halide ion, however, is attributable to the fact that photographic emulsions are prepared and maintained in the presence of a stoichiometric excess of halide ion to avoid the inadvertent reduction of $Ag^+$ to $Ag^o$, thereby avoiding elevating minimum optical densities observed following photographic processing.

As the introduced silver ion is precipitated, it removes iodide ion from the dispersing medium. To restore the equilibrium relationship with iodide ion in solution the silver iodide at the corners of the grains (see relationship III above) exports iodide ion from the corners of the grains into solution, where it then reacts with additionally added silver ion. Silver and iodide ion as well as chloride and/or bromide ion, which was present to provide a halide ion stoichiometric excess, are then redeposited.

To direct deposition to the edges of the tabular grains and thereby avoid thickening the tabular grains as well as to avoid silver ion reduction, the stoichiometric excess of halide ion is maintained and the concentration of the halide ion in the dispersing medium is maintained in those ranges known to be favorable for tabular grain growth. For high (>50 mole percent) bromide emulsions the pBr of the dispersing medium is maintain at a level of at least 1.0. Depending upon the amount of silver introduced and the initial halide ion excess in the dispersing medium, it may be necessary to add additional bromide and/or chloride ion while silver ion is being introduced. However, the much lower solubility of silver iodide as compared to silver bromide and/or chloride, results in the silver and iodide ion interactions described above being unaffected by any introductions of bromide and/or chloride ion.

The net result of silver ion introduction as described above is that silver ion is deposited at the edges of the tabular grains. Concurrently, iodide ion migrates from the corners of the tabular grains to their edges. As iodide ion is displaced from the tabular grain corners, irregularities are created in the corners of the tabular grains that increase their latent image forming efficiency. It is preferred that the tabular grains exhibit a corner surface iodide concentration that is at least 0.5 mole percent, preferably at least 1.0 mole percent, lower than the highest surface iodide concentration found in the grain—i.e., at the edge of the grain.

Although the maximum and minimum percentages of total silver provided by each of CZ, IZ and PZ are either stated or can be calculated from stated values given above, these values along with preferred ranges are grouped below for ease of reference:

| | Percent of Total Silver | | |
|---|---|---|---|
| | Minimum | Maximum | Preferred Range |
| CZ | 35 | 93.5 | 50to90 |
| IZ | 5 | 35 | 10to30 |
| PZ | 1.5 | 60 | 2to30 |

Apart from the features described above the tabular grain emulsions of the invention can take any convenient conventional form. If the starting tabular grain emulsion contains no iodide, a minimum amount of iodide is introduced in forming the intermediate zone and the iodide introduction step that immediately follows, and a maximum amount of silver is introduced during the subsequent silver ion introduction step, the minimum level of iodide in the resulting emulsion can be as low as 0.5 mole percent. With higher levels of iodide introduction, lower levels of subsequent silver ion introduction, and/or iodide initially present in the starting tabular grains, much higher levels of iodide can be present in the tabular grain emulsions of the invention. Preferred emulsions according to the invention contain overall iodide levels of up to 20 mole percent, most preferably, up to 15 mole percent. A preferred minimum overall iodide concentration is 1.5 mole percent, with higher overall iodide concentrations being preferred for photographic applications depending upon iodide release for photographic advantages, such as reliance upon iodide to increase native blue sensitivity or reliance upon iodide ions released in development for interimage effects. For rapid access processing, such as is typically practiced in medical radiography, overall concentrations are preferably maintained at less than 5 mole percent, optimally at less than 3 mole percent.

In the preferred emulsions according to the invention the tabular grains account for greater than 50 percent of total grain projected area. The tabular grains most preferably account for at least 70 percent, optimally at least 90 percent, of total grain projected area. Any proportion of tabular grains satisfying the iodide profile requirements noted above can be present that is capable of observably enhancing photographic sensitivity. When all of the tabular grains are derived from the same emulsion precipitation, at least 25 percent of the tabular grains exhibit the iodide profiles described above. Preferably tabular grains accounting for at least 50 percent of total grain projected area exhibit the iodide profiles required by the invention.

Preferred emulsions according to the invention are those which are relatively monodisperse. In quantitative terms it is preferred that the coefficient of variation (COV) of the equivalent circular diameters (ECD's), based on the total grain population of the emulsion as precipitated be less than about 30 percent, preferably less than 20 percent. The COV of ECD is also referred to as $COV_{ECD}$. By employing a highly monodisperse starting tabular grain emulsion, such as an emulsion having a $COV_{ECD}$ of less than 10 percent (disclosed, for example, by Tsaur et al U.S. Pat. No. 5,210,013, the disclosure of which is here incorporated by reference), it is possible to prepare emulsions according to the invention in which $COV_{ECD}$ of the final emulsion is also less than 10. The silver bromide and iodobromide tabular grain emulsions of Tsaur et al U.S. Pat. Nos. 5,147,771, '772, '773, and 5,171,659 represent a preferred class of starting tabular grain emulsions. Sutton et al U.S. Pat. No. 5,334,469 discloses improvements on these emulsions in which the COV of tabular grain thickness, $COV_t$, is less than 15 percent.

The average tabular grain thicknesses (t), ECD's, aspect ratios (ECD/t) and tabularities ($ECD/t^2$, where ECD and t are measured in micrometers, μm) of the emulsions of the invention can be selected within any convenient conventional range. The tabular grains preferably exhibit an average thickness of less than 0.3 μm. Ultrathin (<0.07 μm mean thickness) tabular grain emulsions are specifically contemplated. Photographically useful emulsions can have average ECD's of up to 10 μm, but in practice they rarely have average ECD's of greater than 6 μm. For relatively slow speed photographic applications any minimum mean ECD of the emulsions of the invention that is compatible with average aspect ratio requirements can be employed. It is preferred to require individual grains to have parallel major faces and to exhibit an average aspect ratio of at least 2 to be considered tabular. Thus the average aspect ratio of the emulsions is always greater than 2, preferably greater than 5 and most preferably greater than 8. Extremely high average aspect ratios of 100 or more are contemplated, although typically tabular grain emulsion average aspect ratios are less than 75.

During their preparation, either during preparation of the starting tabular grain emulsions or during iodide and/or silver addition, the tabular grain emulsions of the invention can be modified by the inclusion of one or more dopants, illustrated by *Research Disclosure,* Vol. 365, September 1994, Item 36544, I. Emulsion grains and their preparation, D. Grain modifying conditions and adjustments, paragraphs (3), (4) and (5). *Research Disclosure* is published by Kenneth Mason Publications, Ltd., Dudley House, 12 North St., Emsworth, Hampshire P010 7DQ, England. Among conventional emulsion preparation techniques specifically contemplated to be compatible with the present invention are those disclosed in *Research Disclosure,* Item 36544, I. Emulsion grains and their preparation, A. Grain halide composition, paragraph (5); C. Precipitation procedures; and D. Grain modifying conditions and adjustments, paragraphs (1) and (6).

Subsequent to their precipitation the emulsions of the invention can be prepared for photographic use as described by *Research Disclosure,* 36544, cited above, I. Emulsion grains and their preparation, E. Blends, layers and performance categories; II. Vehicles, vehicle extenders, vehicle-like addenda and vehicle related addenda; III. Emulsion washing; IV. Chemical sensitization; and V. Spectral sensitization and desensitization, A. Spectral sensitizing dyes.

The emulsions or the photographic elements in which they are incorporated can additionally include one or more of the following features illustrated by *Research Disclosure,* Item 36544, cited above: VII. Antifoggants and stabilizers; VIII. Absorbing and scattering materials; IX. Coating physical property modifying addenda; X. Dye image formers and modifiers; XI. Layers and layer arrangements; XII. Features applicable only to color negative; XIII. Features applicable only to color positive; XIV. Scan facilitating features; and XV. Supports.

The exposure and processing of photographic elements incorporating the emulsions of the invention can take any convenient conventional form, illustrated by *Research Disclosure,* Item 36544, cited above, XVI. Exposure; XVIII. Chemical development systems; XIX. Development; and XX. Desilvering, washing, rinsing and stabilizing.

EXAMPLES

The invention can be better appreciated by reference to the following specific embodiments. The prefix "T" indicates that the invention requirements are satisfied while the prefix "C" indicates a comparison.

Emulsion Preparations

A series of emulsions were prepared demonstrating the grain structure of the invention and closely related, but differing grain structures. The solutions employed for precipitation are listed below, with the number indicating the emulsion in which the solution was first introduced.

Solution A-1

6 g oxidized gelatin 6.7 g NaBr 1.0 mL Pluronic-31R1™, surfactant satisfying the formula:

$$HO-(CH\overset{CH_3}{\overset{|}{C}}H_2O)_y-(CH_2CH_2O)_x-(CH\overset{CH_3}{\overset{|}{C}}H_2O)_{y'}-H \quad (VI)$$

where x=7, y=25 and y'=25

5935 mL distilled water

Solution B-1

0.32M $AgNO_3$

Solution C-1

0.32M NaBr

Solution D-1

8.75 g NaBr 85 mL distilled water

Solution E-1

10.1 g $NH_4SO_4$ 100 mL distilled water

Solution F-1

86.5 g of 2.5M NaOH

Solution G-1

100 g oxidized gelatin 425 mL distilled water

Solution H-1

1.6M $AgNO_3$

Solution I-1

1.6M NaBr

Solution J-1

2.5M $AgNO_3$
Solution K-1

2.5M NaBr
Solution L-1

1.88M KI
Solution L-2

0.376 mole AgI Lippmann emulsion
Solution M-4

2.35M NaBr 0.15M KI

Emulsion CE-1

To solution A-1 at 45° C., pH 1.85, and pAg 9.37 were added with vigorous stirring solutions B-1 and C-1 over a period of 1 minute, precipitating 0.03 mole of AgBr. Solution D-1 was added and held for 1 minute. The temperature was then raised to 60° C. over 9 minutes. Solutions E-1 and F-1 were added sequentially and held for 9 minutes. Solution G-1 was then added, and the pH was adjusted to 5.85 with 4M $HNO_3$. Solutions B-1 and C-1 were added by double-jet addition utilizing accelerated flow over 15 minutes to yield a total of 0.16 mole of AgBr. Solutions H-1 and I-1 were added by double-jet addition utilizing accelerated flow for 21 minutes while maintaining the pAg at 9.09 and consuming an additional 10% of the total silver precipitated. Solutions J-1 and K-1 then replaced solutions H-1 and I-1 under identical conditions while precipitating another 58.6% of the total silver over 44.6 minutes. Solution L-1 was added to the vessel at a flow rate of 100 mL/minute over 2 minutes. The solution was delivered to a position in the vessel such that mixing was maximized. After a 10 minute hold, solutions J-1 and K-1 were resumed at a constant flow rate over 25 minutes while adjusting the pAg to 8.02. The emulsion was then cooled and desalted. Approximately 10.5 moles of silver used to prepare this and subsequent emulsions.

The resultant high aspect ratio tabular grain AgIBr emulsion had an average grain equivalent circular diameter (ECD) of 2.07 μm and a mean thickness of 0.097 μm. Tabular grains accounted for >90% of total grain projected area. The overall (bulk) iodide level was 3.6 mole percent, based on total silver.

Emulsion CE-2

Comparative emulsion CE-2 was prepared identically to Emulsion CE-1, except that solution L-2 was substituted for solution L-1. Solution L-2 was added at once rather than over a 2 minute period. The remainder of the preparation was identical, starting with the 10 minute hold.

The resultant high aspect ratio tabular grain AgIBr emulsion had an average grain ECD of 2.06 μm and a mean thickness of 0.099 μm. Tabular grains accounted for >90% of total grain projected area. The overall (bulk) iodide level was 3.6 mole percent, based on total silver.

Emulsion CE-3

Comparative emulsion CE-3 was prepared identically to Emulsion CE-1, except that the quantity of solution L-1 added to the reaction vessel was increased. Solution L-1 was added over 10 minutes at a flow rate of 38.9 mL/minute. The remainder of the preparation was the same, starting with the final addition of solutions J-1 and K-1.

The resultant high aspect ratio tabular grain AgIBr emulsion had an average grain ECD of 2.05 μm and a mean thickness of 0.098 μm. Tabular grains accounted for >90% of total grain projected area. The overall (bulk) iodide level was 7.0 mole percent, based on total silver.

Emulsion CE-4

Comparative emulsion CE-4 was prepared identically to Emulsion CE-1, the AgBr portion of the tabular grains precipitated prior to the peripheral zone was divided into a central zone; an intermediate zone containing 6 mole percent iodide, based on silver in the intermediate zone, accounting for 20.1 percent of the total silver; a AgBr spacer zone containing 15.1% of total silver; and the peripheral zone.

The preparation of emulsion CE-1 was repeated through the addition of solutions H-1 and I-1. Solutions J-1 and K-1 then replaced solutions H-1 and I-1 under identical conditions while precipitating another 23.5% of the total silver over 25.5 minutes. Solution M-4 replaced solution K-1 for the next 17.3 minutes, during which time 20.1% of the total silver was consumed. Solution K-1 was then substituted for solution M-4 for the next 9.7 minutes over which time another 15.1% of the total silver was precipitated. The remainder of the preparation was identical to that for emulsion CE-1, starting with the addition of solution L-1.

The resultant high aspect ratio tabular grain AgIBr emulsion had an average grain ECD of 1.90 μm and a mean thickness of 0.111 μm. Tabular grains accounted for >90% of total grain projected area. The overall (bulk) iodide level was 4.8 mole percent, based on total silver.

Emulsion CE-5

Comparative emulsion CE-5 was prepared identically to Emulsion CE-4, except that solution L-2 was substituted for solution L-1. Solution L-2 was added at once rather than over a 2 minute period. The remainder of the preparation was identical, starting with the 10 minute hold.

The resultant high aspect ratio tabular grain AgIBr emulsion had an average grain ECD of 1.63 μm and a mean thickness of 0.126 μm. Tabular grains accounted for >90% of total grain projected area. The overall (bulk) iodide level was 4.8 mole percent, based on total silver.

Emulsion IE-6

Invention emulsion IE-6 was prepared identically to Emulsion CE-4, except that the location of the 6 mole percent iodide intermediate zone was shifted so that no spacer zone separated the intermediate zone and the peripheral zone.

The preparation of emulsion CE-1 was repeated through the addition of solutions H-1 and I-1. Solutions J-1 and K-1 then replaced solutions H-1 and I-1 under identical conditions while precipitating another 38.5% of the total silver over 34.6 minutes. Solution M-4 replaced solution K-1 for the next 17.3 minutes, during which time 20.1% of the total silver was consumed. The remainder of the preparation was identical to that for emulsion CE-1, starting with the addition of solution L-1.

The resultant high aspect ratio tabular grain AgIBr emulsion had an average grain ECD of 2.08 μm and a mean thickness of 0.106 μm. Tabular grains accounted for >90% of total grain projected area. The overall (bulk) iodide level was 4.8 mole percent, based on total silver.

The differences in the iodide addition profiles of the emulsions described above can easily visualized by reference to the following schematic diagrams:

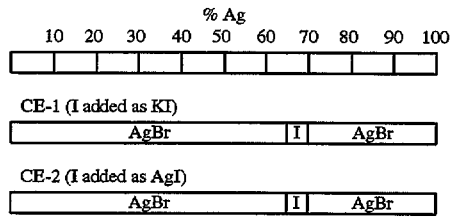

-continued

CE-3 (I added as KI)

| AgBr | I | AgBr |
|---|---|---|

CE-4 (I added as KI)

| AgBr | AgIBr 6 M % I | AgBr | I | AgBr |
|---|---|---|---|---|

CE-5 (I added as AgI)

| AgBr | AgIBr 6 M % I | AgBr | I | AgBr |
|---|---|---|---|---|

IE-6 (I added as KI)

| AgBr | AgIBr 6 M % I | I | AgBr |
|---|---|---|---|

When the I bar shown above represents KI addition, the silver scale is based on the assumption of iodide displacement of edge halide in the host tabular grain. Thus, in this instance the I bar overlaps the prior silver addition. When the I bar is formed by AgI addition, the I bar picks up where prior silver deposition stops. In the completed grains the iodide arrangement differs from the input profile. Iodide is distributed outwardly to the peripheral edges of the tabular grains to form the peripheral zone, and the highest iodide concentrations are found at the peripheral edges of the tabular grains.

A further comparison of the physical characteristics of the grains is provided in Table II.

TABLE II

| Emulsion | Intermed. Zone % Ag | Spacer Zone % Ag | Bulk M % I | Lower I Corners |
|---|---|---|---|---|
| CE-1 | 0 | 0 | 3.6 | yes |
| CE-2 | 0 | 0 | 3.6 | no |
| CE-3 | 0 | 0 | 7.0 | yes |
| CE-4 | 20 | 15 | 4.8 | yes |
| CE-5 | 20 | 15 | 4.8 | no |
| IE-6 | 20 | 0 | 4.8 | yes |

Table II confirms the teaching of Fenton et al that lower corner iodide concentrations than elsewhere in the peripheral zone are not observed when iodide used in forming the peripheral zone is added in the form an AgI Lippmann emulsion.

Sensitometry

All of the emulsions prepared above were chemically sensitized with sulfur and gold and spectrally sensitized with the following green dyes:

Dye 1

Anhydro-5-chloro-9-ethyl-5'-phenyl-3'-(3-sulfobutyl)-3-(3-sulfopropyl)oxacarbocyanine hydroxide triethylamine salt and Dye 2

Anhydro-3,9-diethyl-3'-methylsulfonylcarbamoylmethyl-5-phenyloxathiacarbocyanine hydroxide, inner salt The emulsions were blended with a cyan dye-forming coupler and coated on a photographic film support at a silver coverage of 8.61 mg/dm$^2$. The coatings were exposed through a step wedge to daylight at a color temperature of 5500° K. for 0.01 second, followed by development for 3 minutes 15 seconds using Kodak Flexicolor™ C-41 process (described in British Journal of Photography Annual, 1977, pp. 201–206). The processed samples were evaluated for speed and gamma (γ). Speed is given in relative CR units, where 1 CR unit is equal to 0.01 log E where E represents exposure in lux-seconds. Speed was measured at a toe density of $D_s$, where $D_s$ minus $D_{min}$ equals 20 percent of the slope of a line drawn between $D_s$ and a point D' on the characteristic curve offset from $D_s$ by 0.6 log E.

Gamma (γ) is the slope of the linear portion of the characteristic curve midway between the maximum and minimum densities.

Gamma normalized granularity (GNG) is equal to the root mean square (RMS) granularity measured with a 48 μm aperture on a microdensitometer divided by the gamma. GNG is employed to allow the granularity of emulsions differing in gamma to allow a quantitatively meaningful comparison of the granularity of emulsions differing in gamma. A single normalized granularity unit is generally regarded to be within the measurement uncertainty while 7 units represent approximately one stop (0.3 log E, where E is exposure in lux-seconds) difference in photographic speed.

The photographic performance of the emulsions prepared above is summarized in Table III.

TABLE III

| Emulsion | Bulk M % I | Relative Speed | γ | GNG |
|---|---|---|---|---|
| CE-1 | 3.6 | 100 | 2.64 | 0 |
| CE-2 | 3.6 | 91 | 2.55 | +3 |
| CE-3 | 7.0 | 89 | 1.81 | +4 |
| CE-4 | 4.8 | 99 | 2.40 | 0 |
| CE-5 | 4.8 | 84 | 2.51 | +1 |
| IE-6 | 4.8 | 100 | 2.12 | 0 |

From a comparison of Tables II and III the advantages taught by Fenton et al are confirmed. Emulsion CE-1, which is formed according to the teachings of Fenton et al, exhibits the highest observed speed and the lowest level of granularity. Emulsion CE-2, which substituted AgI for KI in formation of the peripheral zone and therefore failed to achieve lower iodide concentrations at the corners of the completed tabular grains, produced a lower speed and a higher granularity than CE-1, confirms the importance of the peripheral zone iodide profile taught by Fenton et al.

The disadvantage of the CE-1 emulsion of Fenton et al, which comparison emulsion CE-2 also exhibits, is relatively high contrast.

Emulsion CE-3 demonstrates that the contrast of a Fenton et al emulsion can be lowered by approximately doubling the iodide content. This is in itself a disadvantage for the reasons noted that have been previously discussed. Additionally, the increased iodide levels increased GNG and reduced speed. This demonstrates that merely increasing iodide concentrations is not an attractive route to lowering contrast.

Emulsion CE-4 adds an intermediate zone containing 6 mole percent iodide, based on silver within the intermediate zone. Contrast is reduced to a degree while neither speed nor granularity are adversely affected to any significant degree.

Emulsion CE-5 differs from CE-4 by substituting AgI Lippmann emulsion addition for KI addition. Speed is lower and contrast is higher than in Emulsion CE-4. Viewing CE-4 and CE-5 together it is apparent that the addition of an intermediate iodide level zone produces an emulsion that still favorably responds to a peripheral zone construction as taught by Fenton et al.

Emulsion IE-6, satisfying the requirements of the invention, shows performance superior to that of each of the comparison emulsions. Speed and granularity match the levels of Fenton et al emulsion CE-1 and emulsion CE-4, which adds an intermediate zone, but spaced from the peripheral zone. By comparing emulsions IE-6 and CE-4 it is apparent that location of the intermediate zone so that it extends to the peripheral zone results in a further reduction in contrast. Having a 6 mole percent iodide concentration at the outer edge of the host tabular grains at the commencement of formation of the peripheral zone is, of course, contrary to the teachings of Fenton et al.

Although the present invention adds iodide in an intermediate zone to lower contrast, a distinct advantage of the invention is that the added iodide works more efficiently to lower contrast than when iodide is placed at locations not satisfying invention requirements. The efficiency of iodide in reducing contrast can be observed quantitatively as larger negative $\Delta\gamma \div \Delta I$ quotients (assigned negative values, since gamma is decreasing). Using Fenton et al emulsion CE-1 as a reference, the efficiency of iodide increases at varied locations can be appreciated by reference to Table IV. Emulsion CE-2 is omitted from Table IV, since it did not contain an iodide level increase as compared to Emulsion C-1.

TABLE IV

| Emulsion | ΔI (%) | Δγ (%) | Δγ ÷ ΔI | Relative Speed | GNG |
|---|---|---|---|---|---|
| CE-1 | 0 | 0 | Not Appl. | 100 | 0 |
| CE-3 | 94 | −31 | −0.33 | 89 | +4 |
| CE-4 | 33 | −9 | −0.27 | 99 | 0 |
| CE-5 | 33 | −5 | −0.15 | 84 | +1 |
| IE-6 | 33 | −20 | −0.61 | 100 | 0 |

From Table IV it is apparent that emulsion IE-6 representing the invention realized the largest reduction in gamma with the least increase in iodide and still attained high levels of speed and low granularity that were imparted by the peripheral zone constructed according to the teachings of Fenton et al.

The invention has been described in detail with particular reference to preferred embodiments thereof, but it will be understood that variations and modifications can be effected within the spirit and scope of the invention.

What is claimed is:

1. An emulsion of enhanced photographic sensitivity and reduced contrast comprised of a dispersing medium and tabular grains containing greater than 50 mole percent bromide, based on silver, and having a non-uniform iodide distribution, including (a) a peripheral zone extending inwardly from edges and corners of the tabular grains and providing (i) a maximum iodide concentration along the edges and (ii) a lower iodide concentration at the corners than elsewhere along the edges, (b) a central zone providing a minimum iodide concentration and accounting for at least 35 percent of total silver forming the tabular grains and, (c) extending from the central zone to the peripheral zone, an intermediate zone (i) containing a higher iodide concentration than the central zone, ranging from greater than 2 to 10 mole percent, based on silver forming the intermediate zone, and (ii) accounting for from 5 to 35 percent of total silver forming the tabular grains.

2. An emulsion according to claim 1 wherein the tabular grains contain less than 20 mole percent iodide, based on total silver.

3. An emulsion according to claim 2 wherein the tabular grains contain from 0.5 to 15 mole percent iodide, based on total silver.

4. An emulsion according to claim 1 wherein the intermediate zone contains from 2.5 to 8 mole percent iodide, based on silver in the intermediate zone.

5. An emulsion according to claim 1 wherein the peripheral zone contains at least 1.5 mole percent of total silver.

6. An emulsion according to claim 5 wherein the peripheral zone contains from 2 to 30 percent of total silver.

7. An emulsion according to claim 1 wherein the intermediate zone contains from 10 to 30 percent of total silver.

8. An emulsion according to claim 1 wherein the central zone contains from 50 to 90 percent of total silver.

* * * * *